US011828085B1

(12) United States Patent
Tobias et al.

(10) Patent No.: US 11,828,085 B1
(45) Date of Patent: Nov. 28, 2023

(54) SYSTEM FOR LOCK KEYWAY ACCESS MONITORING

(71) Applicants: Marc Tobias, Pittsburgh, PA (US); Tobias Bluzmanis, Miramar, FL (US)

(72) Inventors: Marc Tobias, Pittsburgh, PA (US); Tobias Bluzmanis, Miramar, FL (US)

( * ) Notice: Subject to any disclaimer, the term of this patent is extended or adjusted under 35 U.S.C. 154(b) by 0 days.

(21) Appl. No.: 17/959,571

(22) Filed: Oct. 4, 2022

Related U.S. Application Data

(60) Provisional application No. 63/309,032, filed on Feb. 11, 2022, provisional application No. 63/394,698, filed on Aug. 3, 2022.

(51) Int. Cl.

| | |
|---|---|
| ***E05B 17/02*** | (2006.01) |
| ***E05B 17/14*** | (2006.01) |
| ***E05B 67/38*** | (2006.01) |
| ***E05B 45/00*** | (2006.01) |
| *G08C 17/02* | (2006.01) |
| *E05B 45/06* | (2006.01) |

(52) U.S. Cl.
CPC ..... *E05B 17/142* (2013.01); *E05B 45/005* (2013.01); *E05B 67/38* (2013.01); *E05B 2045/0645* (2013.01); *G08C 17/02* (2013.01)

(58) Field of Classification Search
CPC ..... E05B 17/142; E05B 45/005; E05B 67/38; E05B 2045/0645; G08C 17/02; Y10T 70/47; Y10T 70/493; Y10T 70/496; Y10T 70/498; Y10T 70/7955; Y10T 70/796; Y10T 70/8108; Y10T 70/8216
USPC ..... 70/31, 54–56, 423, 435, 439
See application file for complete search history.

(56) References Cited

U.S. PATENT DOCUMENTS

| | | | | |
|---|---|---|---|---|
| 3,421,350 A * | 1/1969 | Shanok | E05B 77/34 70/455 |
| 3,813,663 A | 5/1974 | Perkins | |
| 3,861,182 A * | 1/1975 | Skinner | E05B 77/34 70/455 |
| 3,873,966 A * | 3/1975 | Tanner | B60R 25/1001 340/545.5 |

(Continued)

FOREIGN PATENT DOCUMENTS

| | | |
|---|---|---|
| CN | 201195967 Y * | 2/2009 |
| CN | 201649822 U * | 11/2010 |

(Continued)

*Primary Examiner* — Suzanne L Barrett
(74) *Attorney, Agent, or Firm* — Jeffrey A. Proehl; Woods, Fuller, Shultz & Smith, PC

(57) ABSTRACT

A system may include a lock assembly having secured and unsecured conditions and having an opening for receiving a lock actuating object. An access restriction element may be positionable with respect to the lock assembly to affect access to the opening of the lock assembly. The access restriction element may have at least two conditions, a blocking condition in which the access restriction element at least partially obstructs access to the opening of the lock assembly and an access condition in which the access restriction element is configured to permit access to the opening of the lock assembly. The system may also include an access detection assembly configured to detect attempted access to the opening of the lock assembly by sensing changing of the access restriction element from the blocking condition to the access condition.

13 Claims, 5 Drawing Sheets

(56) References Cited

U.S. PATENT DOCUMENTS

| | | | | | |
|---|---|---|---|---|---|
| 4,062,314 | A * | 12/1977 | Allen | G08B 13/08 116/85 |
| 4,339,747 | A | 7/1982 | Maybee | |
| 5,668,533 | A | 9/1997 | Jackson, Jr. | |
| 5,680,095 | A | 10/1997 | Nassouri | |
| 6,549,123 | B1 * | 4/2003 | Monahan | B60R 25/1004 340/568.1 |
| 6,598,439 | B1 * | 7/2003 | Chen | E05B 45/06 70/423 |
| 7,466,890 | B2 * | 12/2008 | Kachmar | G08B 13/186 385/16 |
| 7,501,595 | B2 | 3/2009 | Dimig | |
| 9,871,399 | B2 | 1/2018 | Mittleman | |
| 11,156,020 | B2 | 10/2021 | Lin | |
| 2003/0015408 | A1 | 1/2003 | Woods | |
| 2016/0326773 | A1 * | 11/2016 | Tobias | E05B 9/04 |

FOREIGN PATENT DOCUMENTS

| | | | | |
|---|---|---|---|---|
| CN | 203160905 U | * | 8/2013 | |
| CN | 207700857 U | * | 8/2018 | |
| CN | 207700861 U | * | 8/2018 | |
| CN | 207739762 U | * | 8/2018 | |
| DE | 3711586 A1 | * | 10/1988 | |
| DE | 20103571 U1 | * | 6/2001 | E05B 17/186 |
| JP | 3202598 U | * | 2/2016 | |

* cited by examiner

SYSTEM FOR LOCK KEYWAY ACCESS MONITORING

REFERENCE TO RELATED APPLICATIONS

This application claims the priority benefit of U.S. Provisional Patent Application No. 63/309,032, filed Feb. 11, 2022 and U.S. Provisional Patent Application No. 63/394,698, filed Aug. 3, 2022, both of which are hereby incorporated by reference in their entireties.

BACKGROUND

Field

The present disclosure relates to security locks and more particularly pertains to a new system for lock keyway access monitoring for providing an indication of possible access to a lock for legitimate or nefarious purposes.

SUMMARY

In one aspect, the present disclosure relates to a system which may comprise a lock assembly for selectively securing an object, and the lock assembly may have a secured condition and an unsecured condition. The lock assembly may include an opening for receiving a lock actuating object. The system may further include an access restriction element which is positionable with respect to the lock assembly to affect access to the opening of the lock assembly. The access restriction element having a blocking condition in which the access restriction element at least partially obstructs access to the opening of the lock assembly. The access restriction element having an access condition in which the access restriction element is configured to permit access to the opening of the lock assembly. The system may also include an access detection assembly which is configured to detect attempted access to the opening of the lock assembly by sensing changing of the access restriction element from the blocking condition to the access condition.

In another aspect, the present disclosure relates to a system which may comprise a lock assembly for selectively securing an object, with the lock assembly having a secured condition and an unsecured condition. The lock assembly may have an opening for receiving a lock actuating object, and include a lock housing and a lock cylinder positioned in the lock housing. The opening may be located on the lock cylinder. The system may further include an access restriction element positionable with respect to the lock assembly to affect access to the opening of the lock assembly. The access restriction element may have a blocking condition in which the access restriction element at least partially obstructs access to the opening of the lock assembly, and may have an access condition in which the access restriction element is configured to permit access to the opening of the lock assembly. The access restriction element may include an access cover configured to cover the opening of the lock assembly in the blocking condition of the access restriction element and be removed from covering the opening of the lock assembly in the access condition of the access restriction element. The access cover may be removably mountable on the lock housing, and may be movable between a mounted condition on the lock housing and a dismounted condition off of the lock housing. The system may also include an access detection assembly being configured to detect attempted access to the opening of the lock assembly by sensing changing of the access restriction element from the blocking condition to the access condition with respect to the lock assembly. The access detection assembly may include an access sensor configured to mechanically sense movement of the access restriction element with respect to the lock housing.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
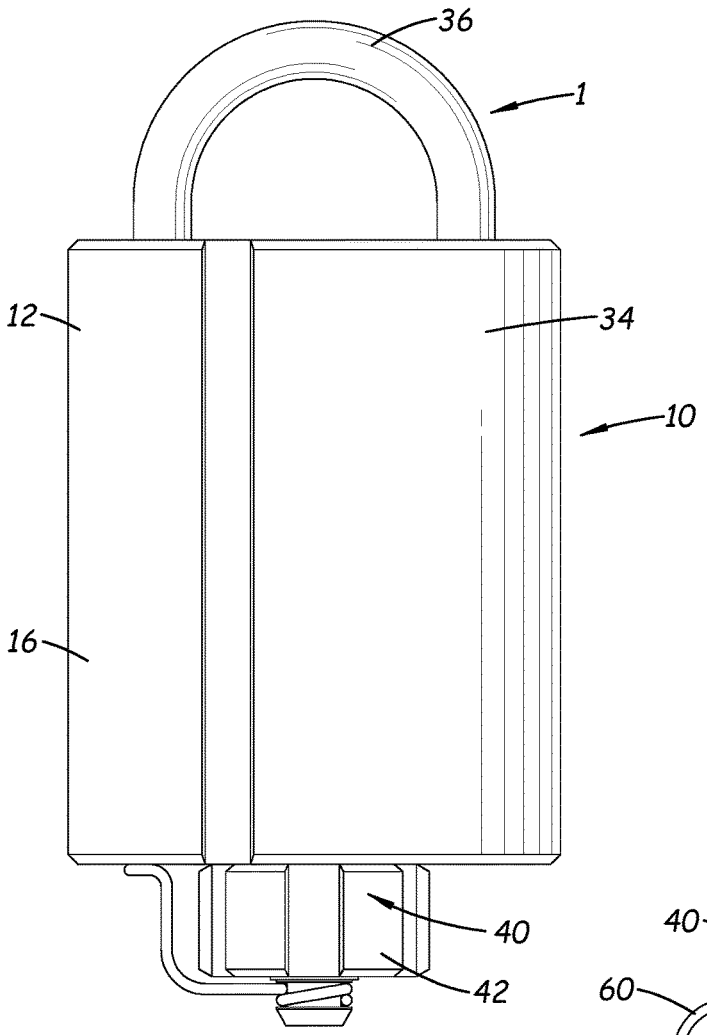
FIG. 1 is a schematic front view of a new system for lock keyway access monitoring, with the lock assembly in the secured condition and the access restriction element in the blocking condition, according to the present disclosure.
Figure 2:
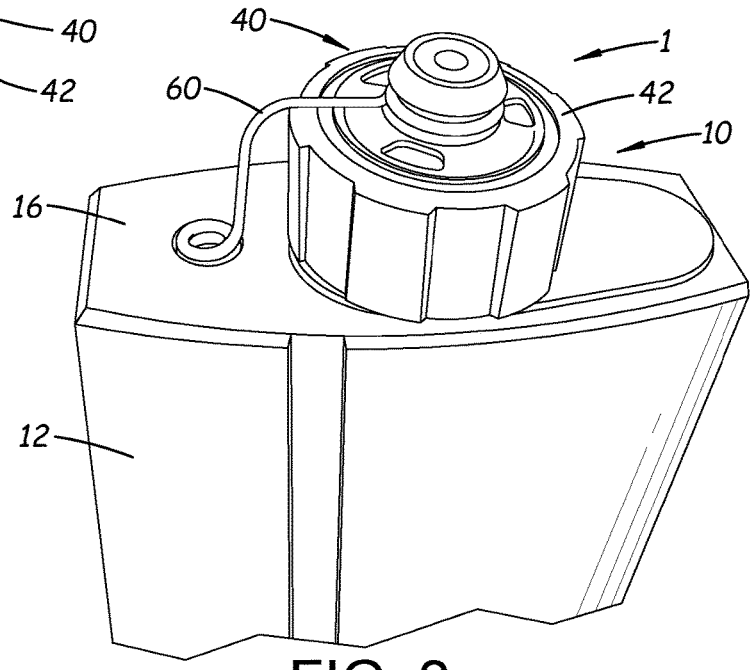
FIG. 2 is a schematic side perspective view of the system, with the access restriction element in the blocking condition, according to an illustrative embodiment.
Figure 3:
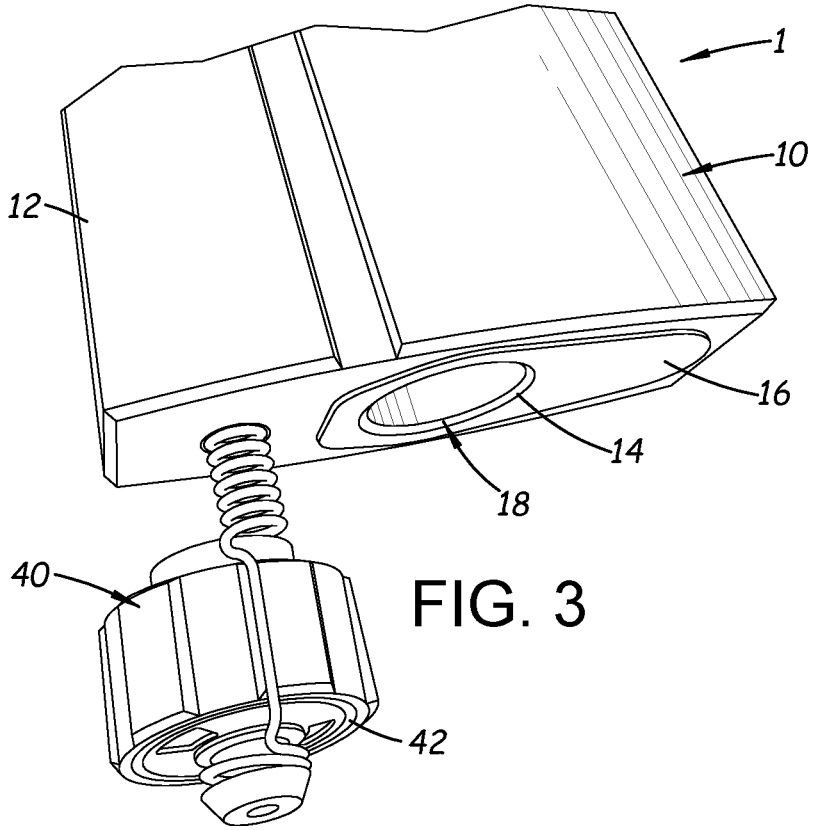
FIG. 3 is a schematic second side perspective view of the system, with the access restriction element in the access condition, according to an illustrative embodiment.
Figure 4:
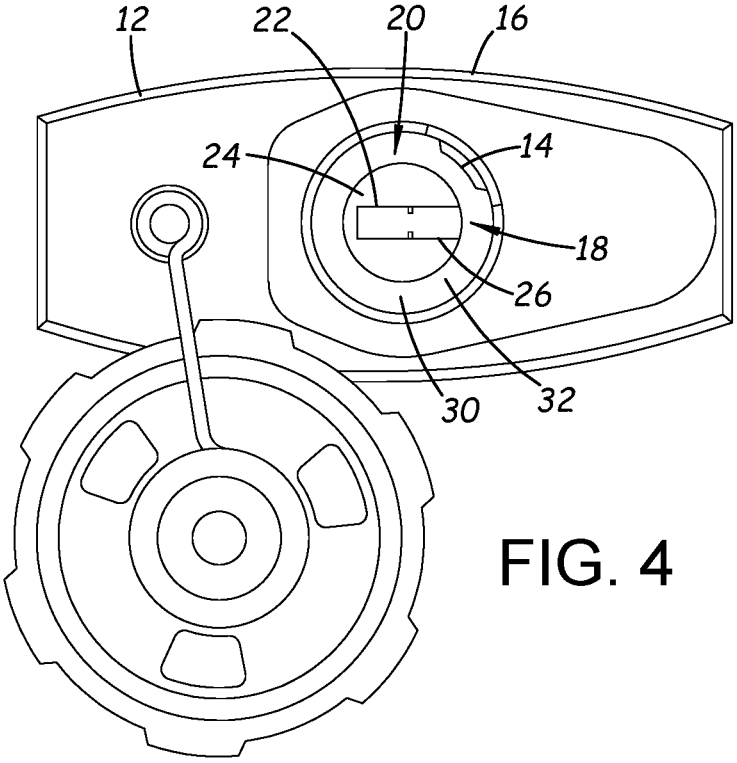
FIG. 4 is a schematic bottom view of the system, with the access restriction element in the access condition, according to an illustrative embodiment.
Figure 5:
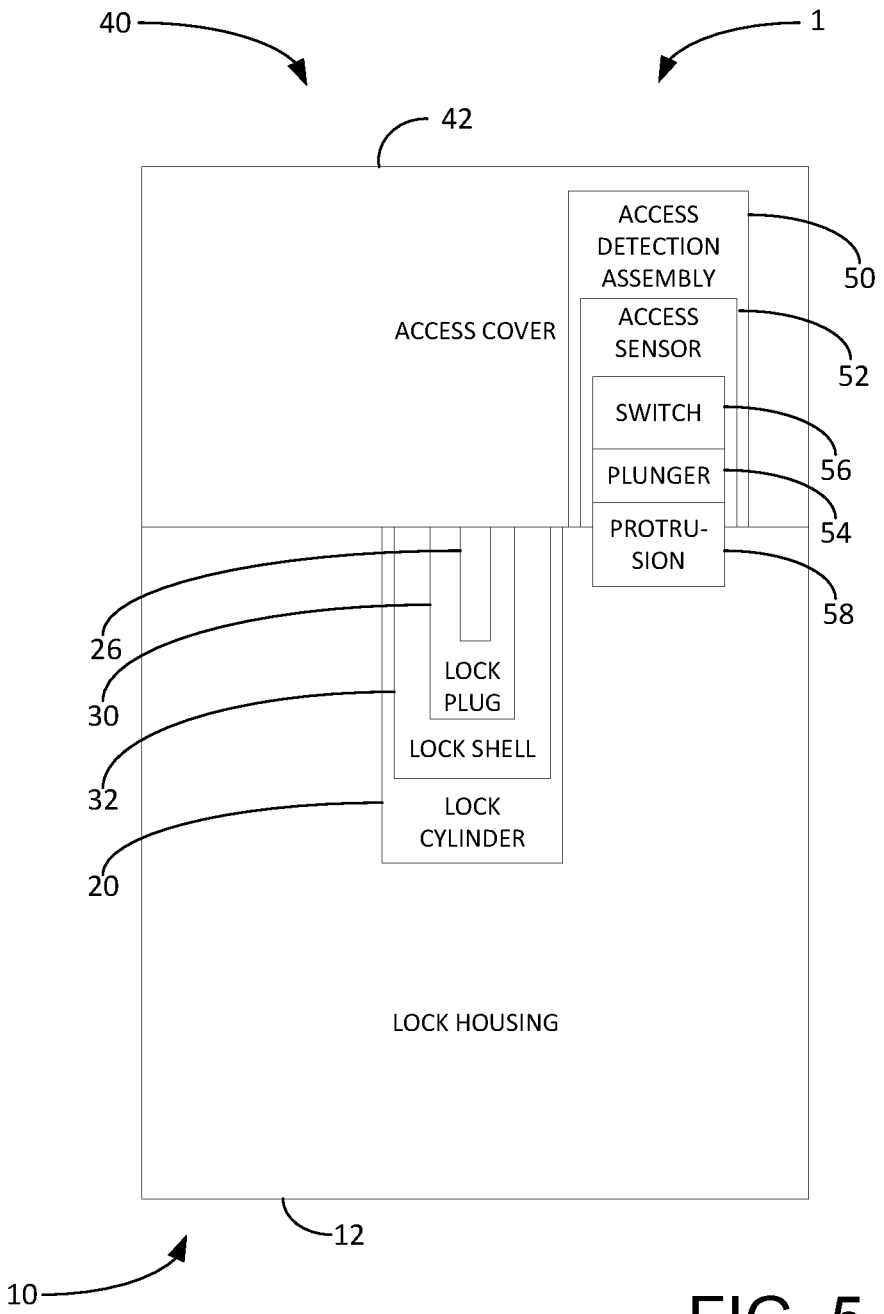
FIG. 5 is a schematic diagram of the system with the access restriction element in the access condition, according to an illustrative embodiment.
Figure 6:
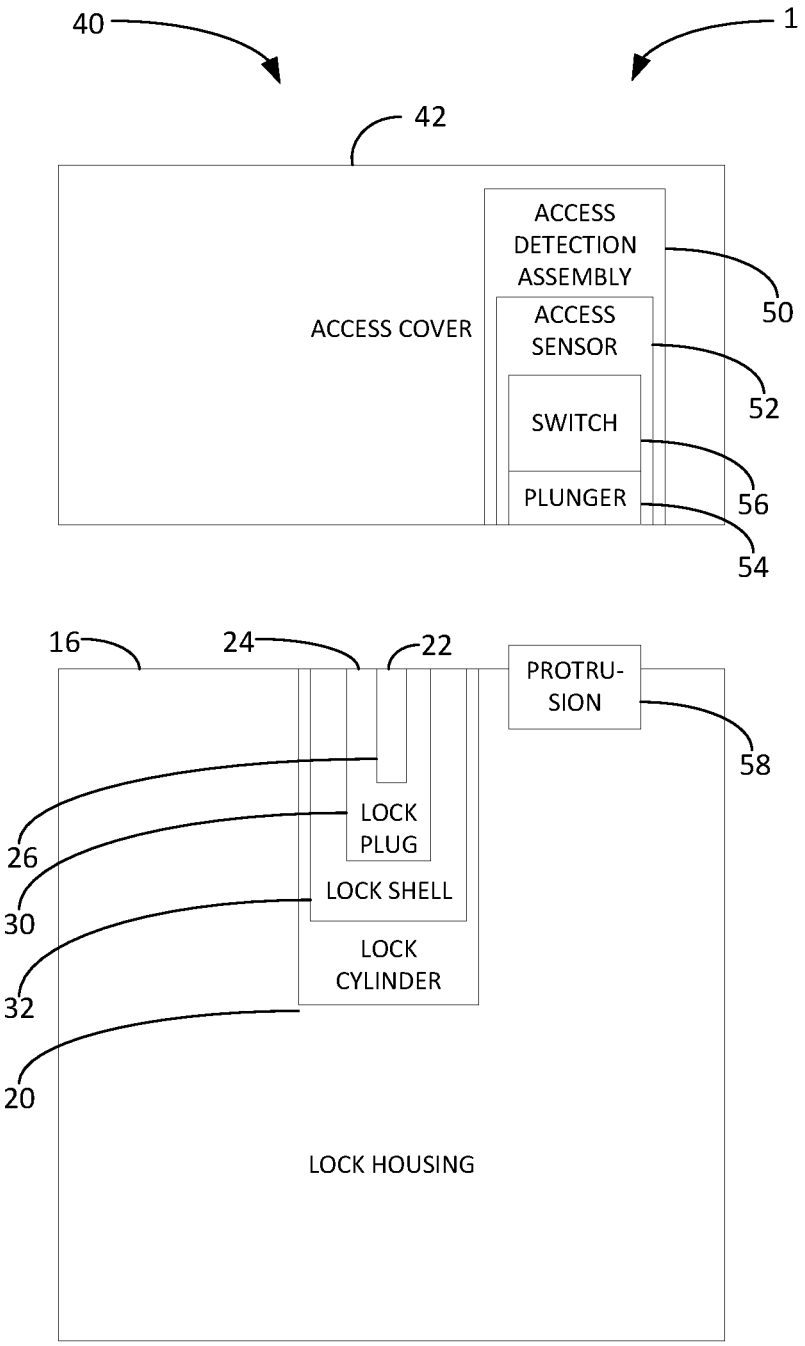
FIG. 6 is a schematic diagram of the system with the access restriction element in the blocking condition, according to an illustrative embodiment.
Figure 7:
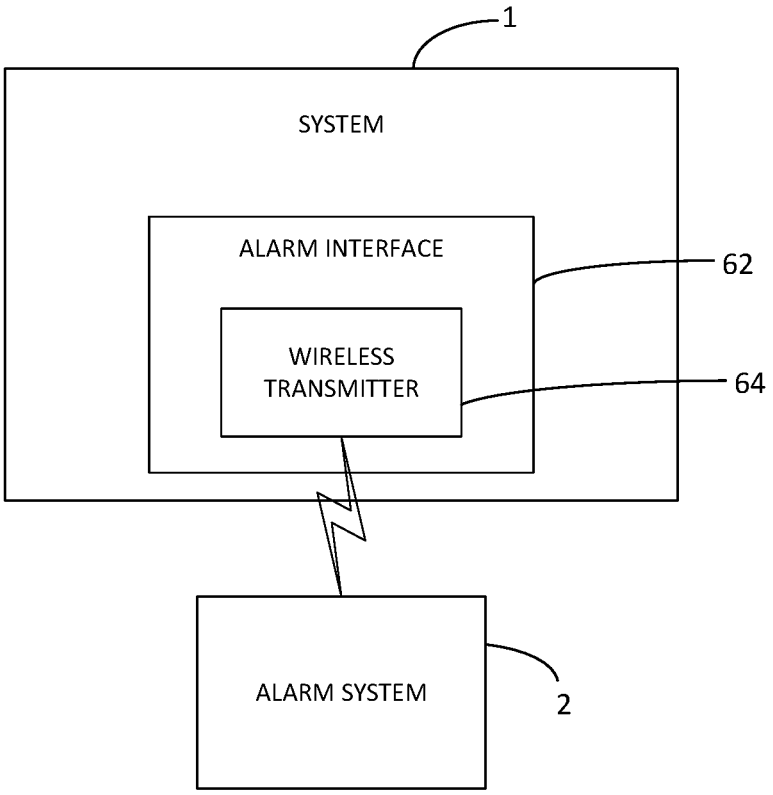
FIG. 7 is a schematic diagram of the system in relation to an alarm system, according to an illustrative embodiment.

With reference now to the drawings, and in particular to FIGS. 1 through 7 thereof, a new system for lock keyway access monitoring embodying the principles and concepts of the disclosed subject matter will be described.

In some aspects, the disclosure relates to a system 1 which may include a lock assembly 10 for selectively securing an object, an access restriction element 40 positionable with respect to the lock assembly 10 in a manner that affects operation of the lock assembly, and an access detection assembly 54 detecting a condition of the access restriction element which may provide an indication of an attempt to operate the lock assembly. In other aspects, the disclosure relates to a combination of the access restriction element 40 and the access detection assembly 54.

In greater detail, the lock assembly 10 of the system 1 may have a secured condition in which the lock assembly may secure or contribute to the securing of an object, and an unsecured condition in which the lock assembly may not appreciably contribute to the securing of the object. In illustrative embodiments, the lock assembly 10 may include a lock housing 12 for fully or partially housing various elements of the lock mechanism of the assembly 10. In some embodiments, the lock housing 12 may define an access rim 14 located on a portion of an exterior surface 60 of the housing 12. The access rim 14 may form a portion of an access cavity 18 extending inwardly from the exterior surface of the lock housing, and the access rim may have an access surface which may be a portion of the exterior surface 60.

The lock assembly 10 may further include a lock cylinder 20 providing means for changing the lock assembly between the secured and unsecured conditions using an authorized means. The lock cylinder 20 may have an opening 22 for receiving a lock actuating object, which in the illustrative embodiments comprises a key object. The lock cylinder 20 may be positioned in the lock housing 12, and the opening 22 may be formed in a face 24 of the lock cylinder. The access rim 14 may be located about the opening 22. The lock cylinder 20 may define an insertion channel 26 extending inwardly from the opening 22 such that the channel receives a portion of the lock actuating object inserted through the opening. In some illustrative applications, the lock actuating object may comprise a key, and the opening and the insertion channel may comprise a keyway for receiving the blade portion of the key. In other illustrative applications, the lock assembly 10 may comprise a combination lock in which access to numbered (or lettered) wheels located on the exterior surface of the lock housing is necessary in order to manipulate the wheels to respective positions showing the correct sequence of numbers or letters.

The lock cylinder 20 of the assembly 10 may further include a lock plug 30 which may be selectively rotatable to change the lock assembly between the secured and unsecured conditions. Illustratively, the lock plug 30 has the opening 22 and the insertion channel 26 formed thereon. The lock plug 30 may form at least a portion of the face 24 of the lock cylinder. The lock cylinder 20 may also include a lock shell 32 which may extend about the lock plug 30, and the lock plug may be selectively rotatable in the shell 32 to cause the lock assembly to change between the secured and unsecured conditions. Typically, the lock plug 30 is rotatable with respect to the lock shell upon insertion of an authorized lock actuating object into the opening 22 of the lock cylinder, such as a key that is correctly bitted for the particular lock assembly.

In one illustrative application, the lock assembly 10 may comprise what is commonly referred to as a "padlock" in which the lock housing 12 comprises a lock case 34 of generally hardened character, and a shackle 36 extending outwardly from the lock case. The shackle 36 may be movably mounted on the case 34 to move between a secured position in the secured condition of the lock assembly 10 and an unsecured position in the unsecured condition of the lock assembly. In another illustrative application, the lock assembly 10 may comprise a door lock mounted on or otherwise integrated with a closure for an opening to secure the closure in a closed position across the opening. In still another illustrative application, the lock assembly 10 may comprise a trigger lock mountable on a firearm to restrict access to the trigger of the firearm.

The access restriction element 40 of the system 1 may be positionable with respect to the lock assembly 10 in a manner that affects operation of the lock assembly, such as, for example, access to the opening 22 and the insertion channel 26 of the lock cylinder 20, or as another example access to the wheels of a combination lock. The access restriction element 40 may have other functionality, such as providing protection of the opening 22 from the entry of various environmental elements which may include moisture and dirt or debris. The restriction element 40 may be movable among at least two conditions, and the conditions may be characterized by having different effects on the access to elements of the lock assembly which may influence the ability to operate the lock assembly.

In some embodiments, one of the conditions of the access restriction element 40 comprises a blocking condition in which the access restriction element at least partially obstructs access to the opening 22 of the lock cylinder thus making accessing of the opening difficult or impossible. The blocking condition may thus be characterized by blocking insertion of an object (such as a lock actuating object) into the opening 22. The blocking condition may thus restrict or block insertion of, for example, a key into the keyway of the lock cylinder or, as another example, insertion of a tool or device employed to attempt to "pick" or otherwise operate the lock assembly via unauthorized means.

Another one of the conditions of the access restriction element 40 may comprise an access condition in which the access restriction element 40 is configured to permit access to the opening 22 of the lock cylinder unhindered or obstructed by the element 40. The access condition may thus permit an object to be inserted into the opening of the lock cylinder, such as a key into the keyway of the lock cylinder.

In the illustrative embodiments, the access restriction element 40 comprises an access cover 42. In such embodiments, the blocking condition of the access restriction element 40 is characterized by the access cover 42 being positioned in a blocking position in which the cover 42 covers at least a portion of the opening 22 of the lock cylinder. The blocking position of the access cover 42 may be further characterized by the access cover being positioned adjacent to the face 24 of the lock cylinder, and may optionally abut against the face. The access condition of the access restriction element 40 may be characterized by the access cover 42 being positioned in an access position in which the access cover is moved out of the blocking position and away from the opening 22 of the lock cylinder, and typically the face 24 of the lock cylinder, to a location characterized by the access cover not blocking or impeding access to the opening. As used in this description, the access position is not necessarily one distinct position, and may include a variety of positions that do not fall under the meaning of the blocking position.

In some embodiments, the access cover 42 may be removably mountable on the lock housing 12, and may be movable between a mounted condition with respect to the housing 12 and a dismounted condition with respect to the housing 12. The mounted condition of the access cover 42 may generally correspond to the blocking position, and the dismounted condition of the cover 42 may generally correspond to the access position. Illustratively, the mounted condition may be characterized by the access cover 42 being at least partially positioned in the access cavity 18 of the lock housing, and the dismounted condition may be characterized by the access cover being removed from the access cavity 18.

In some implementations, the relationship of the access restriction element 40, such as the access cover 42, to the lock assembly 10 may have multiple aspects. Illustratively, the relationship may include a magnetic interaction aspect and a physical manipulation aspect. The magnetic interaction aspect of the relationship may contribute to a securement of the access restriction element 40 (e.g., access cover 42) with respect to the lock assembly. The physical manipulation aspect may provide detection of the access restriction element 40 in the blocking condition, such as the access cover 42 being in the blocking position.

In embodiments, the magnetic interaction aspect may be configured to hold the access cover 42 in the blocking position by a magnetic attraction force, and the magnetic attraction force applied to the cover 42 may permit separation of the cover 42 from the lock cylinder 20 into the access position of the access cover. The access cover 42 may be movable with respect to the lock cylinder from the blocking position to the access position by application of physical force to the access cover and/or the lock assembly sufficient to overcome the magnetic attraction force between the access cover and some element of the lock assembly 10, such as the lock housing 12 or the lock cylinder. The magnitude of the application of physical force necessary to produce movement out of the blocking position may be characterized by the force appliable by the hands of a human.

The magnetic interaction aspect may include one element of the access cover 42 and the lock assembly 10 incorporating a magnetically-active element and another element of the access cover and the lock assembly incorporating a magnetically-receptive element so that the access cover and the lock assembly are magnetically attracted toward each other.

The access detection assembly 50 may provide the physical manipulation aspect of the relationship between the access restriction element 40 and the lock assembly 10. In some implementations, the access detection assembly 50 may be configured to detect an attempted access to the opening 22 of the lock cylinder 20, such as when access restriction element 40 is moved out of the blocking condition, such as by moving the access cover 42 out of the blocking position.

In some embodiments, the access detection assembly 50 may be mounted on, and may be integrated with, the access restriction element 40, and more specifically the access cover 42, which may facilitate the retrofitting or adding on of the detection assembly 52 to an existing lock assembly. In other embodiments the detection assembly 50 may be mounted on the lock assembly 10, such as integration into the lock housing 12 of the assembly 10. In illustrative embodiments, the access detection assembly 50 may include an access sensor 52 which is configured to mechanically sense movement of the access cover 42 with respect to the lock housing, such as the movement of the access cover out of the blocking position with respect to the opening 22 of the lock cylinder. Further, the access sensor 52 may be configured to sense movement of the access cover 42 to the access position.

In embodiments, the access sensor 52 may comprise a plunger 54 movable by the access restriction element 40, is in the blocking condition, such as when the access cover 42 is in the blocking position. The plunger 54 may be moved by movement of the access cover 42 into the blocking position. In some embodiments, the plunger 54 may be movable between an actuated condition and an unactuated condition. The actuated condition of the plunger 54 may correspond to the access cover 42 being moved into the blocking position and/or being in the blocking position. The unactuated condition of the plunger 54 may correspond to the access cover 42 being moved out of the blocking position and/or being in the access position. In illustrative embodiments, such as when the detection assembly 50 is mounted on the lock assembly 10, a portion of the plunger 54 may extend into the access cavity 18 to engage the access cover 42 when the access cover is in the blocking position and in the access cavity, such that the plunger is extended in the unactuated condition and at least partially retracted in the actuated condition. A portion of the plunger 54 may be extendable with respect to other parts of the lock housing.

The access detection assembly 50 may further include an electrical switch 56 connected to the plunger 54, and the switch 56 may be actuated or operated by movement of the plunger between the actuated condition and the unactuated condition. Continuity or discontinuity via the electrical switch 56 may provide an indication of the condition of the plunger (e.g. the actuated and/or unactuated condition) and may provide an indication of the position of the access cover 42 (e.g., the blocking and/or access position). The detection assembly 50 may also include a protrusion 58 that is configured to engage the plunger 54. For example, the protrusion 58 may extend from the lock housing 12 to depress the plunger 54 on the access cover 42, and may depress the plunger 54 when the access cover is moved toward the blocking position, and may maintain the plunger in the depressed condition while the cover is in the blocking position until the cover is moved out of the blocking position. In another example, the protrusion 58 may extend from the access cover 42 to depress a plunger 54 positioned on the lock housing.

Optionally, a tether structure 60 may be provided to tether the access cover 42 to the lock housing 12. The tether structure may extend between the access cover and the lock housing, and may be connected to the access cover and to the lock housing.

Embodiments of the access detection assembly 50 of the system 1 may also include an alarm interface 62 configured to send an alerting signal to an alarm system 2 or other components external to the system 1. The alarm interface 62 may be associated with the access restriction element 40 (such as on the access cover 42) or the lock assembly 10 (such as on the lock housing 12). The alarm interface 62 may be configured to send the alerting signal wirelessly to the external alarm system. The alarm interface 62 may include a wireless transmitter 64 configured to send the alerting signal to the alarm system.

The alarm interface 62 may be configured to send the alerting signal when the access restriction element is moved out of the blocking condition, such as by moving the access cover out of the blocking position. Optionally, the alarm interface 62 may be configured to send the alerting signal when the access cover is or remains out of the blocking position, or even when the access cover is moved into the blocking position. The alarm interface may transmit the alerting signal when the access sensor 52 senses, for example, that the access cover has been moved out of the blocking positon, and toward the access position. In some implementations, the alarm interface 62 may be configured to send the alerting signal when the condition of the plunger 54 changes.

In some embodiments, the access cover and the lock housing may be provided with mounting features for removably mechanically mounting the access cover on the lock housing, which may be utilized in addition to, or instead of, the mounting provided magnetic interaction aspect.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

Further, those skilled in the art will appreciate that steps set forth in the description and/or shown in the drawing figures may be altered in a variety of ways. For example, the order of the steps may be rearranged, substeps may be performed in parallel, shown steps may be omitted, or other steps may be included, etc.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

We claim:

1. A system comprising:

a lock assembly for selectively securing an object, the lock assembly having a secured condition and an unsecured condition, the lock assembly having a lock housing with an access cavity extending inwardly into the lock housing from an exterior surface of the lock housing, the lock housing having an opening located in the access cavity for receiving a lock actuating object;

an access restriction element positionable with respect to the lock assembly to affect access to the opening of the lock housing, the access restriction element having a blocking condition in which the access restriction element at least partially obstructs access to the opening of the lock housing, the access restriction element having an access condition in which the access restriction element is configured to permit access to the opening of the lock housing, the access restriction element including an access cover covering the opening of the lock housing in the blocking condition of the access restriction element and being removed from covering the opening of the lock housing in the access condition of the access restriction element, the blocking condition of the access restriction element being further characterized by the access cover being at least partially positioned in the access cavity of the lock housing, the access condition of the access restriction element being further characterized by the access cover being removed from the access cavity of the lock housing to expose the opening for receiving the lock actuating object;

an access detection assembly being configured to detect attempted access to the opening of the lock housing by sensing removal of the access cover of the access restriction element from being at least partially positioned in the access cavity of the lock housing in the blocking condition to the access cover being removed from the lock housing in the access condition, the access detection assembly including an access sensor configured to sense movement of the access cover out of the access cavity and thus out of the mounted condition with respect to the lock housing to permit access to the opening of the lock housing in the access cavity; and an alarm interface configured to send an alerting signal to a security apparatus, the alarm interface being configured to send the alerting signal wirelessly to the security apparatus;

wherein a relationship of the access cover of the access restriction element to the lock assembly has a magnetic interaction aspect, the magnetic interaction aspect providing a degree of securement of the access cover to the lock housing to hold the access cover at least partially in the access cavity in the blocking position by a magnetic attraction force.

2. The system of claim 1 wherein the magnetic attraction force between the access cover and the lock housing is configured to permit separation of the access cover from the lock housing into the access position of the access cover, the access cover being movable with respect to the lock cylinder from the blocking position to the access position by application of physical force to at least one of the access cover and the lock assembly that overcomes the magnetic attraction force between the access cover and the lock housing.

3. The system of claim 2 wherein the magnetic interaction aspect comprises at least one of the access cover and the lock assembly incorporating a magnetically-active element and another one of the access cover and the lock assembly incorporating a magnetically-receptive element such that the access cover and the lock assembly are magnetically attracted toward each other.

4. The system of claim 1 wherein the relationship of the access cover of the access restriction element to the lock assembly has a physical manipulation aspect, the physical manipulation aspect providing detection of the access restriction element in the blocking condition.

5. The system of claim 1 wherein the access sensor of the access detection assembly comprises a plunger, the plunger being in a retracted position when the access cover is in the blocking condition adjacent to the lock housing, the plunger being in an extended position when the access cover is in the access condition away from the lock housing, the plunger being moved from the extended position to the retracted position when the access cover is moved from the access condition to the blocking condition.

6. The system of claim 5 wherein the plunger of the access detection assembly is movable between an actuated condition corresponding to the retracted position of the plunger and an unactuated condition corresponding to the extended position of the plunger, the actuated condition corresponding to the access cover abutting the lock housing in a blocking position of the access cover, the unactuated condition corresponding to the access cover being spaced from the housing in an access position of the access cover.

7. The system of claim 1 wherein at least one of the access cover and the lock housing has mounting features for removably mounting the access cover on the lock housing.

8. The system of claim 1 wherein the alarm interface is associated with one of the lock assembly and the access restriction element.

9. The system of claim 1 wherein the access cover is movable with respect to the lock housing between a blocking position corresponding to the blocking condition and an access position corresponding to the access condition; and wherein the alarm interface is configured to send the alerting signal when the access cover is moved out of the blocking position.

10. A system comprising:

a lock assembly for selectively securing an object, the lock assembly having a secured condition and an unsecured condition, the lock assembly having an opening for receiving a lock actuating object, the lock assembly includes a lock housing and a lock cylinder positioned in the lock housing, the opening being located on the lock cylinder;

an access restriction element positionable with respect to the lock assembly to affect access to the opening of the lock assembly, the access restriction element having a blocking condition in which the access restriction element at least partially obstructs access to the opening of the lock assembly, the access restriction element having an access condition in which the access restriction element is configured to permit access to the opening of the lock assembly, the access restriction element including an access cover configured to cover the opening of the lock assembly in the blocking condition of the access restriction element and be removed from covering the opening of the lock assembly in the access condition of the access restriction element, the access cover being removably mountable on the lock housing, the access cover being movable between a mounted condition on the lock housing and a dismounted condition off of the lock housing, the blocking condition of the access restriction element being further characterized by the access cover being at least partially positioned in the access cavity of the lock housing, the access condition of the access restriction element being further characterized by the access cover being removed from the access cavity of the lock housing to expose the opening for receiving the lock actuating object;

an access detection assembly being configured to detect attempted access to the opening of the lock assembly by sensing removal of the access cover of the access restriction element from being at least partially positioned in the access cavity of the lock housing in the blocking condition to the access condition, the access detection assembly including an access sensor configured to mechanically sense movement of the access cover of the access restriction element and thus out of the mounted condition with respect to the lock housing;

wherein a relationship of the access cover of the access restriction element to the lock assembly has a magnetic interaction aspect, the magnetic interaction aspect providing a degree of securement of the access cover to the lock housing to hold the access cover in the blocking position by a magnetic attraction force;

wherein the magnetic attraction force between the access cover and the lock housing is configured to permit separation of the access cover from the lock housing into the access position of the access cover, the access cover being movable with respect to the lock cylinder from the blocking position to the access position by application of physical force to at least one of the access cover and the lock assembly that overcomes the magnetic attraction force between the access cover and the lock housing, at least one of the access cover and the lock assembly incorporating a magnetically-active element and another one of the access cover and the lock assembly incorporating a magnetically-receptive element such that the access cover and the lock assembly are magnetically attracted toward each other; and an alarm interface configured to send an alerting signal to a security apparatus, the alarm interface being configured to send the alerting signal wirelessly to the security apparatus;

wherein the relationship of the access cover of the access restriction element to the lock assembly has a physical manipulation aspect, the physical manipulation aspect providing detection of the access restriction element in the blocking condition, the lock housing including an access cavity extending into the housing, the opening of the lock assembly being located in the access cavity such that insertion of a said lock actuating object into the opening requires movement of the actuating object into the access cavity, the access cover being movable between a mounted condition on the lock housing and a dismounted condition off of the lock housing, the mounted condition being characterized by at least a portion of the access cavity cover being positioned in the access cavity when the restriction element is in the blocking condition.

11. The system of claim 10 wherein the access sensor includes a plunger, the plunger being in a retracted position when the access cover is in the blocking condition adjacent to the lock housing, the plunger being in an extended position when the access cover is in the access condition away from the lock housing, the plunger being moved from the extended position to the retracted position when the access cover is moved from the access condition to the blocking condition.

12. The system of claim 11 wherein the plunger of the access detection assembly is movable between an actuated condition corresponding to the retracted position of the plunger and an unactuated condition corresponding to the extended position of the plunger, the actuated condition corresponding to the access cover abutting the lock housing in a blocking position of the access cover, the unactuated condition corresponding to the access cover being spaced from the housing in an access position of the access cover.

13. The system of claim 10 wherein at least one of the access cover and the lock housing has mounting features for removably mounting the access cover on the lock housing.

* * * * *